US009815608B2

(12) United States Patent
Pellingra et al.

(10) Patent No.: US 9,815,608 B2
(45) Date of Patent: Nov. 14, 2017

(54) MULTI-COMPARTMENT POUCH WITH BREAKABLE INNER COMPARTMENT

(71) Applicant: Ampac Holdings, LLC, Cincinnati, OH (US)

(72) Inventors: Salvatore Pellingra, Newport, KY (US); Allyson Smith, Cincinnati, OH (US); Martin Kropf, Muchenbuchsee (CH)

(73) Assignee: AMPAC HOLDINGS, LLC, Cincinnati, OH (US)

( * ) Notice: Subject to any disclaimer, the term of this patent is extended or adjusted under 35 U.S.C. 154(b) by 114 days.

(21) Appl. No.: 13/801,205

(22) Filed: Mar. 13, 2013

(65) Prior Publication Data

US 2013/0301957 A1 Nov. 14, 2013

Related U.S. Application Data

(60) Provisional application No. 61/645,559, filed on May 10, 2012.

(51) Int. Cl.

| | |
|---|---|
| ***B65D 33/00*** | (2006.01) |
| ***B65D 30/00*** | (2006.01) |
| ***B65D 30/22*** | (2006.01) |
| ***B65D 65/26*** | (2006.01) |
| ***B65D 81/32*** | (2006.01) |

(52) U.S. Cl.
CPC ..... *B65D 81/3266* (2013.01)

(58) Field of Classification Search
CPC ..... B65D 81/3266
USPC ..... 383/37–40, 208, 35
See application file for complete search history.

(56) References Cited

U.S. PATENT DOCUMENTS

| | | | | | |
|---|---|---|---|---|---|
| 3,073,507 | A | * | 1/1963 | Trewella et al. | 206/439 |
| 3,156,352 | A | * | 11/1964 | Hayhurst | 206/219 |
| 3,543,999 | A | * | 12/1970 | Kugler | 383/6 |
| 4,000,996 | A | | 1/1977 | Jordan | |
| 4,256,256 | A | * | 3/1981 | Meyers | 383/40 |
| 4,496,046 | A | * | 1/1985 | Stone | B29C 65/04 206/219 |
| 4,637,061 | A | * | 1/1987 | Riese | 383/38 |
| 4,961,495 | A | * | 10/1990 | Yoshida et al. | 206/219 |
| 4,994,056 | A | | 2/1991 | Ikeda | |

(Continued)

FOREIGN PATENT DOCUMENTS

| | | |
|---|---|---|
| JP | 09169366 | 6/1997 |
| JP | 09249266 | 9/1997 |
| JP | 2005162291 | 6/2005 |

*Primary Examiner* — Derek Battisti
(74) *Attorney, Agent, or Firm* — Perman & Green, LLP

(57) ABSTRACT

Provided is a multi-compartment pouch with a breakable or openable inner compartment used for mixing of two or more ingredients contained within the compartments without opening the pouch to the atmosphere. In one form, a two-compartment pouch includes a top compartment and a bottom compartment and an inner gusset separating the top compartment from the bottom compartment. The inner gusset includes an openable region and a fold line, and means for grasping and pulling apart the front and rear panels of the pouch to cause the openable region to open to allow for the combining of contents of the top compartment with contents of the bottom compartment without opening the pouch. Also provided are methods for making the multi-compartment pouch.

22 Claims, 12 Drawing Sheets

(56) References Cited

U.S. PATENT DOCUMENTS

| | | | | |
|---|---|---|---|---|
| 6,076,968 | A | 6/2000 | Smith et al. | |
| 6,164,825 | A | 12/2000 | Larkin et al. | |
| 6,604,651 | B2 * | 8/2003 | Amundson | B65D 83/0805 206/233 |
| 7,055,683 | B2 | 6/2006 | Bourque et al. | |
| 7,160,029 | B2 * | 1/2007 | Bein et al. | 383/67 |
| 7,306,095 | B1 | 12/2007 | Bourque et al. | |
| 7,938,580 | B2 | 5/2011 | Gaskell et al. | |
| 8,104,959 | B2 * | 1/2012 | Lucas et al. | 383/10 |
| 2001/0017950 | A1 * | 8/2001 | Strand et al. | 383/204 |
| 2002/0166463 | A1 | 11/2002 | Rasile et al. | |
| 2004/0005100 | A1 | 1/2004 | Versluys | |
| 2005/0220374 | A1 * | 10/2005 | Thomas | B65D 33/2591 383/105 |
| 2006/0008183 | A1 * | 1/2006 | Johansen | B65D 75/5888 383/61.2 |
| 2008/0031554 | A1 | 2/2008 | Taheri | |
| 2008/0177243 | A1 | 7/2008 | Roger | |
| 2009/0175563 | A1 | 7/2009 | Weaver | |
| 2009/0190862 | A1 * | 7/2009 | Barksdale et al. | 383/64 |
| 2010/0054636 | A1 | 3/2010 | Owensby et al. | |
| 2010/0159083 | A1 | 6/2010 | Peplinski et al. | |
| 2010/0236951 | A1 * | 9/2010 | Huff et al. | 206/222 |
| 2012/0074002 | A1 | 3/2012 | Steele et al. | |

* cited by examiner

MULTI-COMPARTMENT POUCH WITH BREAKABLE INNER COMPARTMENT

CROSS-REFERENCE TO RELATED APPLICATIONS

This application is a non-provisional of and claims the benefit of U.S. Provisional Application No. 61/645,559 filed May 10, 2012 which is incorporated by reference herein in its entirety.

FIELD

The present disclosure relates to the field of pouches. It more particularly relates to pouches with two or more separate compartments for holding ingredients that are to be mixed together.

BACKGROUND

Pouches for packaging materials often times may need to include two or more ingredients, which have to be maintained separate from one another prior to being used. Multi-compartment pouches are used to keep ingredients separate prior to use. For example, multi-compartment pouches may include food ingredients that need to be mixed together just prior to or during the food cooking process. For examples, spices, flavorings or seasonings for foods may be advantageously kept separate from the food item to be spiced, flavored or spiced until just before consumption or cooking.

Prior art multi-compartment pouches may use internal steam pressure generated during the microwave cooking process to rupture a frangible barrier or layer between two compartments such that the ingredients from one compartment may pass into a second compartment during the cooking process. For example, U.S. Patent Publication No. 2009/0175563 discloses a flexible pouch for microwave steaming which includes a support wall which divides the interior of the pouch into a food compartment, adjacent the top end, and a liquid compartment, formed between the support wall and a bottom end of the pouch. The food is positioned on the support wall and liquid is provided in the liquid compartment so that when the pouch is positioned within a microwave oven and the liquid in the liquid compartment is heated, steam is created, which flows through the porous support wall to heat the food supported thereon.

U.S. Patent Publication No. 2010/0159083 discloses a multi-compartment pouch for use in cooking foodstuffs in a microwave oven where different food stuffs are contained within the different compartments and upon cooking, the layer separating the two compartments bursts under pressure to permit flow of one foodstuff into the other compartment within the pouch while permitting cooking to continue thereafter at a pressure above atmospheric pressure.

Prior art multi-compartment pouches may also use internal pressure generated by squeezing the pouch to rupture a frangible region between two compartments to allow for the commingling of the ingredients in the respective compartments. For example, U.S. Pat. No. 7,306,095 discloses a multiple-compartment pouch having an internal frangible seal for confining a fluid and related beverage container with a re-closable fitment for storing and delivering two different flavored liquids or the like. The frangible seal of the clear plastic pouch bursts when subjected to a sustained squeeze thus allowing the flavors to swirl and mix within the pouch.

A need exists for an improved multi-compartment pouch, which may include two or more ingredients for mixing prior to use and which includes an improved mechanical means for breaking or opening the region between the two compartments to allow for improved mixing of the ingredients without exposing the contents of the pouch to the atmosphere.

BRIEF DESCRIPTION OF DRAWINGS

To assist those of ordinary skill in the relevant art in making and using the subject matter hereof, reference is made to the appended drawings, wherein.

DETAILED DESCRIPTION

Figure 1:
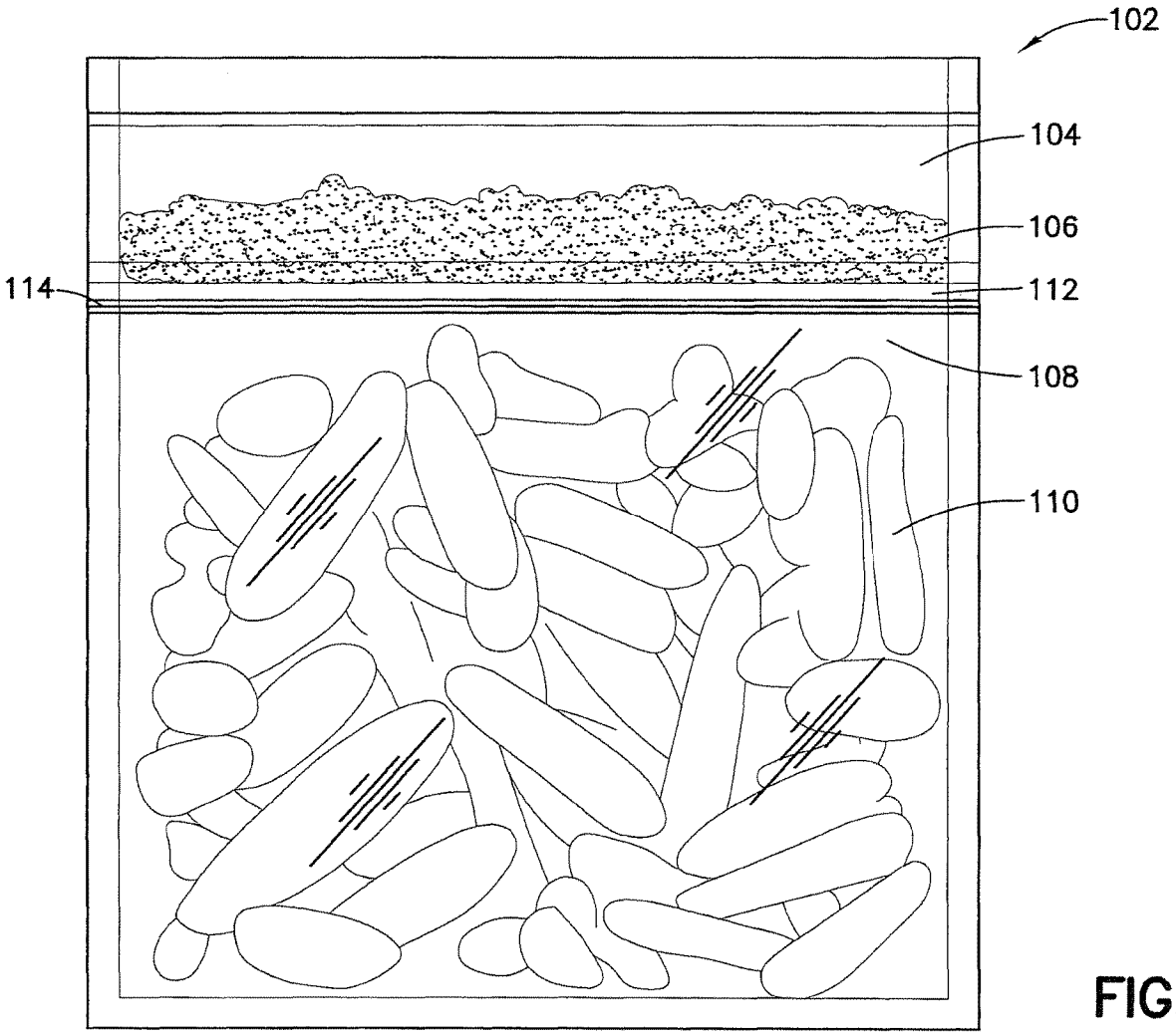
FIG. 1 depicts a front elevation view of an exemplary two-compartment pouch with an openable inner gusset for separating the two compartments with a top compartment for spices/seasonings and the bottom compartment for vegetables.

All numerical values within the detailed description and the claims herein are modified by "about" or "approximately" the indicated value, and take into account experimental error and variations that would be expected by a person having ordinary skill in the art.

Overview

The present disclosure provides a novel multi-compartment pouch including an openable region between at least two of the compartments, wherein the ingredients in adjacent compartments may be mixed or comingled by the use of tabs, outer folds or fins for opening the openable region. The openable region may be frangible, wherein by pulling on the tabs, outer folds or fins in the outward direction causes the frangible region to rupture and the contents of the at least two compartments to mix together. The multi-compartment pouch is distinguishable over the prior art in providing tabs, outer folds or fins on the outside of the pouch that allows for the user to easily pull them apart and correspondingly open a region separating compartments holding different ingredients or components and allowing them to comingle.

The multi-compartment pouch of the present disclosure offers significant advantages relative to prior art multi-compartment pouches including a simplified mechanical means for initiating the mixing of components as opposed to relying on internal pressure generated from cooking or internal pressure generated from squeezing the pouch. One of the advantages of the multi-compartment pouches disclosed herein is that it allows for the user to more easily and cleanly mix ingredients together without having to open the pouch to the atmosphere, and correspondingly results in reduced waste. Another advantage of the multi-compartment pouch disclosed herein is that allows for the packaging of two dissimilar ingredients that need to be separate during filling, distribution and storage to be packaged in one container/pouch while still allowing for the two ingredients to be easily blended together at the time of use by a consumer. Another advantage of the multi-compartment pouch disclosed herein is that allows for the simultaneous filling of the two or more compartments with ingredients as opposed to the sequential filling of the two or more compartments. Another advantage of the multi-compartment pouch disclosed herein is that it can be produced on standard pouch making and standard pouch filling machinery with only tooling changes.

The separate compartments of the multi-component pouch for holding the ingredients may provide the necessary barrier properties against light, air, moisture and oxygen, etc., necessary for the particular ingredients. The openable inner gusset separating the adjacent compartments of the pouch may include one or more means for opening the region, including, but not limited to, perforations, scores, a zipper, a peelable seal, and a hook and loop fastener area. The openable inner gusset may include a frangible region separating two of the compartments of the pouch. The frangible region includes a weakened region that may be fractured or ruptured upon pulling the tabs, outer folds or fins on the outside panels of the pouch in an outward direction from the pouch itself. The frangible region may include perforations, or score lines in the inner gusset area such as to make the region weaker than the outer seal areas of the pouch. The inner gusset is advantageously folded in the pouch and may include a fold line in the form of a "V" where the fold line is the tip of the "V." The perforations or scores lines may be formed in the weakened frangible region with the use of laser or through other mechanical means known in the art. The perforations or score line may traverse the entire width of the inner gusset area of the top compartment or only a portion of the width of the inner gusset area of the top compartment. Where the entire width of the inner gusset area is not weakened with perforations or score lines, it is preferable that the center region of the inner gusset include such perforations or score lines. For example, no greater than 20% of the width, or no greater than 40% of the width, or no greater than 60% of the width, or no greater than 80% of the width of the inner gusset of the top compartment may include perforations or score lines. The perforations or score lines may be formed in a single line across the inner gusset, or alternatively there may be two, three or even four rows of perforations of scores lines formed in the weakened inner gusset area. It is also preferable that the perforations or score line be located within the fold line of the openable folded inner gusset.

Alternatively, the openable area may not be a weakened frangible region, but rather an openable region that includes for example a zipper assembly, or a hook and loop fastener assembly, or a peelable seal area. The peelable seal may be formed via a heat sealing process, or an adhesive pressure sealing process or alternatively using an ultrasonic sealing means. The openable region in the inner gusset may traverse the entire width of the inner gusset area of the top compartment or only a portion of the width of the inner gusset area of the top compartment. Where the entire width of the inner gusset area is not openable, it is preferable that the center region of the inner gusset be openable as opposed to the region near the side seals via a zipper assembly, or a hook and loop fastener assembly, or a peelable seal. For example, no greater than 20% of the width, or no greater than 40% of the width, or no greater than 60% of the width, or no greater than 80% of the width of the inner gusset of the top compartment may include an openable region The openable region may be formed in a single line across the inner gusset, or alternatively there may be two, three or even four rows of openable regions (zippers, hook and loop fasteners, peelable seals or a combination thereof) formed in the inner gusset area.

In an alternative embodiment, the openable region in the inner gusset area may include a combination of two or more rows of score lines, perforations, hook and loop fastener assemblies, zipper assemblies and/or peelable seals depending on the particular packaging application. A zipper assembly and a hook and loop fastener assembly would allow for the openable area to be reclosed after a portion of the contents in the top compartment are mixed into the bottom compartment.

The multi-compartment pouch disclosed herein also includes a means for grasping onto the front and back panels and pulling the two panels in an outward direction from the pouch in order to open the openable inner gusset area. The means for grasping onto the front and back panels such as to pull the panels apart may include, but is not limited to, pull tabs, pull grips, pull fins, outer folds, or other means positioned on opposite sides of the front and rear panels of the pouch and in close proximity to openable inner region to allow a user of the pouch to pull the outer walls or panels of the pouch apart adjacent to the openable region, and thus open the inner gusset wall separating the two compartments to allow for their respective ingredients to comingle or intermix together. In one preferred form, the openable region is a frangible or weakened inner gusset with perforations or score lines to weaken it. Upon pulling on the pull tabs, pull grips, fins, or outer folds, the perforations or score lines open up or fracture sufficiently to allow for the ingredient in the top compartment to pass through the perforations or scores and enter into the bottom compartment of the pouch. For example, the top compartment of the multi-compartment pouch may include spices or seasonings and the bottom compartment may include vegetables. Upon rupturing of the weakened frangible region by pulling on the external pull tabs, pull grips, or folds, the spices or seasonings fall from the top compartment into the bottom compartment to mix with the vegetables. The pouch may also be agitated/shaken to further facilitate the mixing of contents of the top compartment and the bottom compartment. The external pull tabs, pull fins, pull grips, or folds, act as handles for the user to allow for ease of pulling apart the openable inner gusset that includes perforations, score lines, a peelable seal area, a zipper assembly, hook and loop fastener assembly or combinations thereof. For example, in one form the openable inner gusset may include both a line of perforations and a zipper assembly. In another form, the openable inner gusset may include both a line of perforations and a peelable seal area. In yet another form, the openable inner gusset may include both a zipper assembly and a peelable seal area. In still yet another form, the openable inner gusset may include both a line of perforations and a peelable seal area. In still yet another form, the openable inner gusset may include both a line of perforations and a hook and loop fastener assembly.

As discussed above, the openable inner gusset separating the two compartments of the multi-compartment pouch may be opened by pulling apart from the outside of the multi-compartment pouch by a user with the use of pull tabs, pull grips, pull fins, or outer folds the perforated, scored, zippered or peelable area of the inner gusset. The outer folds, grips, fins or tabs are formed on the outside surface of the outer web or panels of the pouch and may be aligned with the openable inner gusset area of the separate compartment in such a way such that when they are pulled in opposite directions, the openable area opens and allows for the contents of the two adjacent compartments to mix with one another.

The multi-compartment pouch disclosed herein may also include a recloseable feature, such as a zipper assembly or a hook and loop fastener assembly (i.e. a Velcro® fastener assembly) at the top of the pouch to reseal the pouch and help preserve product freshness after initial opening to the atmosphere and use. A tear tape or strip may also be used to allow the user to gain access to the zipper assembly or the hook and loop fastener assembly positioned near the top of the multi-compartment pouch after the ingredients in the two or more compartments are combined together.

In another form of the multi-compartment pouch disclosed herein, the top compartment after it is emptied into the bottom compartment may be removed or separated from the remainder of the pouch. Non-limiting exemplary means for removing or separating the top compartment from the bottom compartment include a tear notch, a tear perforation, a laser score, etc. in one or both edges of the pouch just below the weakened frangible region in the pouch. After the top compartment of the pouch is separated or removed from the bottom compartment, the bottom compartment may be provided with a means for reclosing it. Non-limiting exemplary means for reclosing the bottom compartment after it is removed/separated from the top compartment include a zipper assembly, hook and loop fastener assembly or combinations thereof. This form of the multi-compartment pouch with a separable top compartment facilitates and makes easier the removal of the mixed product in the bottom compartment of the pouch. In addition, when this form of the multi-compartment pouch is coupled with a zipper assembly or other reclosing means, it provides for the ability to store the pouch contents after mixing to help preserve freshness.

Pouch Materials

Non-limiting exemplary materials used to form the multi-compartment pouches disclosed herein include films of polyester, nylon, polypropylene, high density polyethylene, low density polyethylene, linear low density polyethylene, copolymers of ethylene, propylene or butene-1 and terpolymers of ethylene, propylene or butene-1, and polystyrene and other similar film materials. The multi-component pouch may be formed from, for instance, a monolayer film, a coextruded film, or a multilayer laminated film or a film in film type construction (i.e. structural film on outside and barrier film on inside) or any other suitable thin film material. A monolayer film may be formed from, for instance, a blown film or a cast film comprising of polypropylene, polyethylene, nylon, or any other suitable materials for use in a film. In alternate aspects, a monolayer film may be formed from any suitable material by any suitable means. The monolayer film may also have additives included for improved processing or physical characteristics of the resultant monolayer film. For example, monolayer films may also be formed with additives which modify transparency, feel, print quality, or barrier properties of the film, or any other suitable film characteristics which may be desirable.

The multi-component pouch may also be formed from a coextruded film. A coextruded film may be formed from blown film or a cast film and may further use combinations of resin types which are coextruded to form multiple layers. The film materials used to form a coextruded film may include polyester, polypropylene, polyethylene, nylon, or ethylene vinyl alcohol, or any other suitable film material. The film materials may be combined in multiple layers in any suitable configuration for desirable characteristics of the resultant coextruded film. A coextruded film may have any suitable number of layers. The multi-compartment pouch may also be formed from a laminated film Laminated films may be comprised of a combination of co-extruded and/or monolayer films similar to those discussed previously. A laminated film may be laminated by any suitable lamination technology, including, but not limited to, extrusion, thermal bonding, and solvent or solventless lamination technologies. In alternate aspects, any suitable means of lamination of films may be used. The lamination configuration may be adjustable so that the resultant film may have desirable characteristics, for instance barrier properties, coefficient of friction, print layer characteristics, varnish, texture, and any other suitable characteristics desirable in a resultant film.

Exemplary Embodiment 1 Including Pull Tabs, Fins or Handles

Referring to FIG. 1, a multi-component pouch including two compartments (also referred to as a two-compartment pouch) with a breakable inner compartment 102 is depicted which includes a top compartment 104 for storage of spices, seasonings or flavorings 106, and a bottom compartment 108 for storage of a food item 110 to be spiced, seasoned or flavored prior to cooking and/or consumption. Separating the top compartment 104 and the bottom compartment 108 is a folded inner gusset 112 that may be a frangible weakened openable area of the pouch or alternatively a non-weakened openable area, or a combination of the two.

With regard to a frangible weakened openable area, the folded inner gusset 112 may have a series of perforations or score lines (not shown) within it or alternatively may be peelable to provide for weakening of the wall. The perforations or score lines are opened upon the user grabbing hold of pull tabs, pull grips, pull fins, or other means 114 positioned on the outside panels of the pouch 102 adjacent to and on opposite sides of the inner gusset area 112. The pulling action by the user of the pouch 102 on the pull tabs, pull grips, fins, or other means 114 results in the perforations or score lines in the inner gusset area 112 opening up, or the inner gusset peeling apart at or near the fold line, which allows the spices, seasonings or flavorings 106 in the top compartment 104 to pass to the bottom compartment 108 and to be applied to the food item 110.

Figure 2:
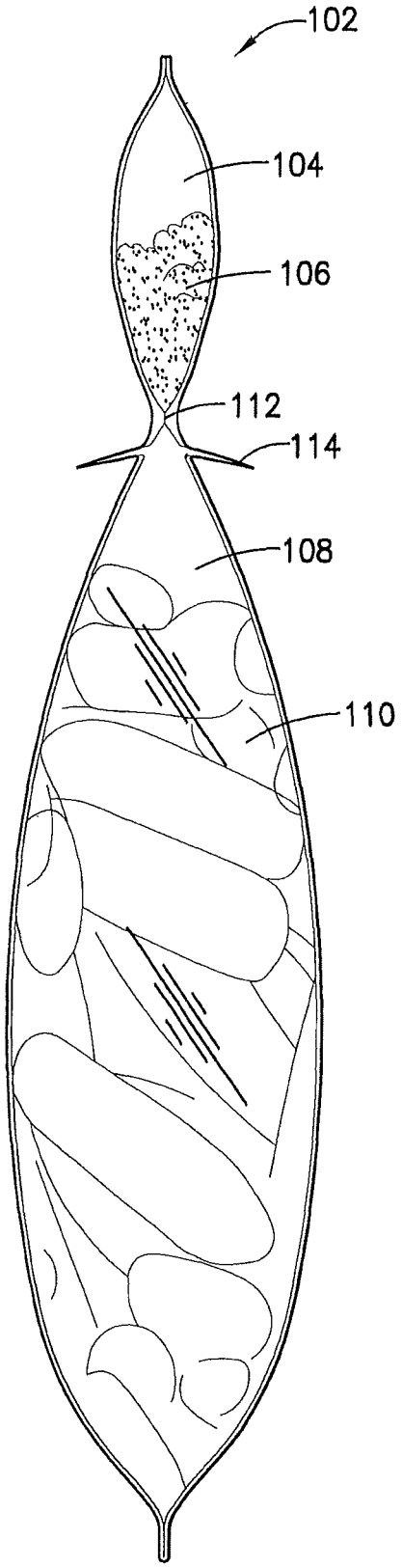
FIG. 2 depicts a side view of the two compartment pouch of FIG. 1 with the openable inner gusset closed and side tabs or fins adjacent the openable inner gusset for pulling open the openable inner gusset.

With regard to a non-weakened openable area, the folded inner gusset 112 may have a zipper assembly or a hook and loop fastener assembly (not shown) within it, which are in the closed position to keep the spices, seasonings or flavorings 106 in the top compartment 104 separate from the food item 110 to be spiced in the bottom compartment 108. The zipper assembly or hook and loop fastener assembly are opened by the user grabbing hold of pull tabs, pull grips, pull fins, or other means 114 positioned on the outside panels of the pouch 102 adjacent to and on opposite sides of the inner gusset area 112. The pulling action by the user of the pouch 102 on the pull tabs, pull grips, fins, or other means 114 results in the zipper assembly or hook and loop fastener assembly in the inner gusset area 112 opening up, which allows the spices, seasonings or flavorings 106 in the top compartment 104 to pass to the bottom compartment 108 of the pouch 102 and to be applied to the food item 110. Referring to FIG. 2, the two-compartment pouch 102 of FIG. 1 is shown with the folded openable inner gusset 112 in the closed position such that the spices/seasonings/flavorings 106 in the top compartment 104 are maintained separate from the food item to be seasoned 110 in the bottom compartment 108.

Figure 3:
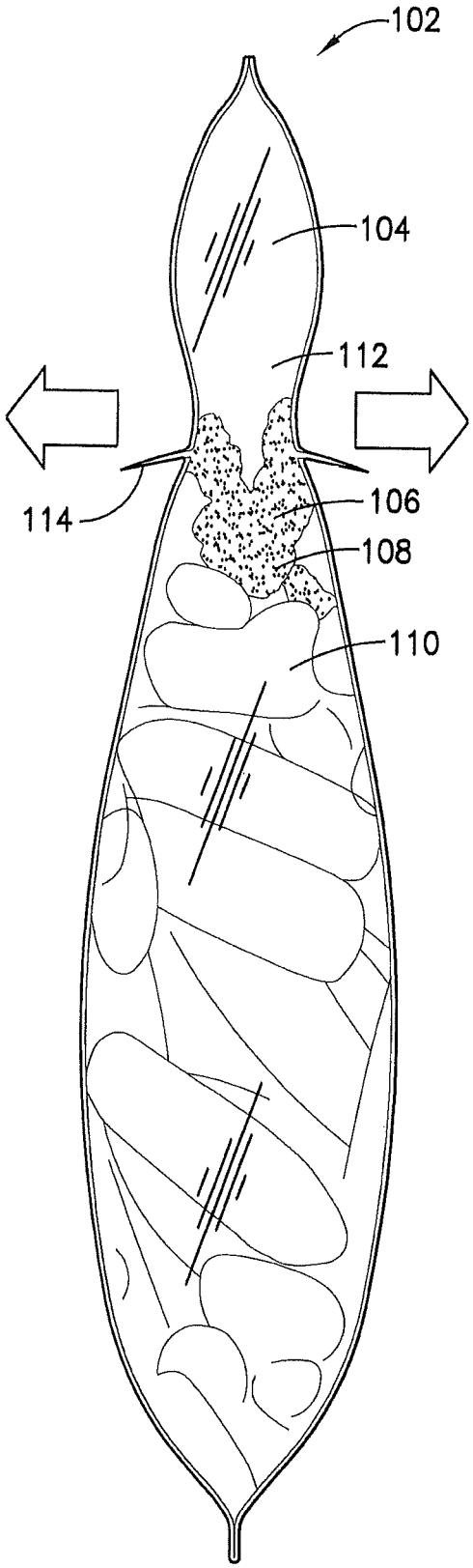
FIG. 3 depicts a side view of the two compartment pouch of FIG. 1 with the openable inner gusset opened by pulling in the outward direction on the side tabs or fins to allow for mixing of the spices/seasonings in the top compartment with the vegetables in the bottom compartment.

Referring to FIG. 3, the two-compartment pouch 102 of FIG. 1 is shown with the folded openable inner gusset 112 pulled apart to allow for the passing of spices/seasonings/flavorings 106 from the top compartment 104 to the bottom compartment 108 to season the food item 110. The inner gusset 112 separating the top compartment 104 and the bottom compartment 108 is pulled open by the user exerting an outward pull force on the pull tabs, pull grips, or pull fins, 114 positioned on the outside panels of the pouch 102 and adjacent to the weakened inner gusset 112. This causes the folded openable inner gusset 112 to unfold and the outward force causes the perforations, scores lines, peelable seal, zipper assembly, hook and loop fastener assembly or combination thereof in the folded openable inner gusset wall 112 to open up and allow for the spices or seasonings or flavorings 106 to pass into the bottom compartment 108 of the pouch 102 and season or flavor the food item 110 contained therein.

Figure 4:
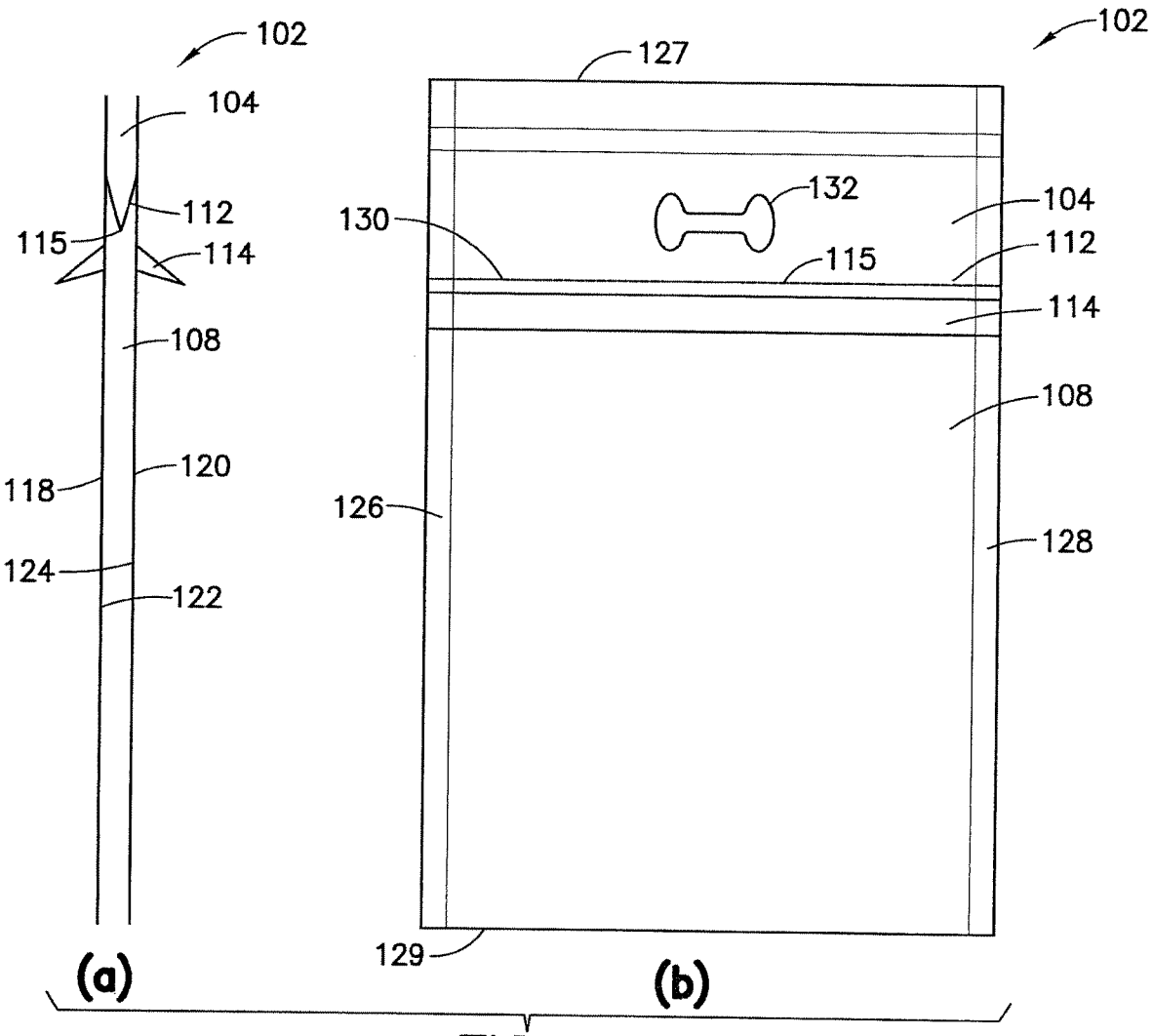
FIG. 4 depicts a side view and a front elevation view of an exemplary two-compartment pouch including two compartments and two fins positioned adjacent an openable inner gusset for pulling the gusset open to allow for the mixing of the contents of the top compartment with the bottom compartment.

Referring to FIGS. 4 (*a*) and (*b*), a side view and a front elevation view of an exemplary two-compartment pouch including two compartments and two fins, tabs, grips or handles positioned adjacent a folded openable inner gusset are depicted. Referring to FIG. 4 (*a*), a side view of the two-compartment pouch 102 is shown in the closed position with two fins, tabs or grips 114 positioned on the outside panels of the pouch and adjacent to the folded openable inner gusset 112 for pulling it apart. The two fins 114 are attached to the outer front and rear walls or panels 118, 120 of the pouch 102 below the folded inner gusset 112. Upon the user of the pouch 102 grasping and pulling the two fins 114 outward and in opposite directions, the inner gusset 112 will unfold and expand causing the openable region in the inner gusset to open up, which results in the ingredients or contents (not shown) of the top compartment 104 falling into the bottom compartment 108 of the pouch 102 and mixing with the ingredients or contents (not shown) in the bottom compartment 108. The pull fins 114 may be alternatively located in other regions of the outer front and rear walls or panels 118, 120 of the pouch 102, however, the closer the proximity to the folded openable inner gusset 112 results in a greater impact in unfolding and expanding the inner gusset 112 during the pulling action by the user. Hence, when the user is ready to mix the contents (not shown) located in the top compartment 104 of the pouch 102 with the contents (not shown) in the bottom compartment 108 of the pouch 102, he or she pulls outward in opposite directions on the two fins, tabs, handles or grips 114 to expand the folded openable inner gusset 112 and cause the openable means (perforations, score lines, peelable seal, zipper assembly, hook and loop fastener assembly or combinations thereof (not shown)) integral to the folded openable inner gusset 112 to open up, and thus allowing the contents in the top compartment 104 to flow by a) gravity from the top compartment 104 into the bottom compartment 108 and mix with the contents (not shown) in the bottom compartment 108 and/or b) shaking the pouch 102 or other means to agitate the pouch 102 to allow for the contents in the top compartment 104 to mix with the contents in the bottom compartment 108. The result is that the contents in the top compartment 104 and the bottom compartment 108 are combined without the user having to open the pouch 102 to the atmosphere.

Referring still to FIG. 4 (*a*), the inner gusset 112 is sealed to the inner front and rear walls or panels 122, 124 of the pouch 102 and is in a folded configuration after pouch formation and after packaging of the ingredients in the pouch 102. There is an openable region or means in the inner gusset 112, such as for example, perforations, score lines, a peelable seal, a zipper assembly, a hook and loop fastener assembly or combinations thereof. The openable means in the folded inner gusset 112 may be in the fold line 115 (for example, a row of perforations along the fold line, or a zipper assembly located at the fold line). Alternatively, the openable means of the folded inner gusset 112 may be located on either side of the fold line 115 itself or on both sides of the fold line 115 of the inner gusset 112 to further increase the ease of openability of the inner gusset 112. However, when for example, two rows of perforations are located on either side of the fold line 115, there is a greater risk of a piece of the inner gusset 112 breaking off and falling into the bottom compartment 108, and thus contaminating the contents for mixing.

Referring to FIG. 4 (*b*), a front elevation view of an the exemplary two-compartment pouch 102 is depicted, It includes two compartments 104, 108 and two fins 114 for pulling apart a folded openable inner gusset 112. The exemplary two-compartment pouch 102 is shown with no ingredients contained therein and is sealed along the two side edges 126, 128. The two-compartment pouch 102 is without any contents or ingredients located therein, and therefore the top and bottom ends 127, 129 of the pouch 102 are not sealed. The top end 127 would be sealed after an ingredient is placed in the top compartment 104 and the bottom end 129 would be sealed after a different ingredient is place in the bottom compartment 108. In this form, the two compartments need to be filled and sealed in a sequential manner as the pouch 102 would need to be flipped 180 degrees after the top compartment 104 is filled and sealed and prior to the bottom compartment 108 from being filled and sealed. The side edges 126, 128 and the top and bottom edges 127, 129 may be sealed by any means known in the art, including, but not limited to heat sealing, ultrasonic sealing and adhesive sealing.

In another form of this embodiment (not shown), the top and bottom ends 127, 129 of the pouch 102 are sealed during the pouch making process, as well as one of the side seals (either 126 or 128), however one of the sides (either 126 or 128) of the pouch 102 is left open to expose the top compartment 104 and bottom compartment 108 for filling and sealing. In this advantageous form of the embodiment, both top 104 and bottom 108 compartments may be side filled simultaneously by rotating the pouch 90 degrees such that the unsealed side edge is facing up for filling and subsequent sealing. In this form, the sealing of the two compartments 104, 108 may also occur simultaneously after the filling operation. This form of the embodiment provides for economic benefits for the person or entity who/that will be filling and sealing the pouch due to fewer process operations and steps.

As shown in FIG. 4 (*b*), the top compartment 104 is smaller than the bottom compartment 108, however the relative size of the compartments may be varied such as to be equal in size or alternatively the top compartment 104 being larger than the bottom compartment 108. The size of the compartments depends on the volume of the ingredients to be packaged within them. However, generally, the top compartment 104 is smaller in volume than the bottom compartment 108. The inner gusset 112 is sealed to the inner front wall 122 and inner rear wall (not shown) of the pouch 102 by any means known in the art, including, but not limited to heat sealing, ultrasonic sealing and adhesive sealing, and is in a folded configuration after pouch formation. In one advantageous form of an openable region as shown in FIG. 4 (*b*), a line of perforations or scores 130 along the fold line 115 in the inner gusset 112 provides a weakened frangible region, such that when a user desires to mix the contents or ingredients of the top compartment 104 with the bottom compartment 108, he or she pulls the two pull tabs or pull fins 114 in opposite and outward directions causing the inner gusset 112 to unfold and expand out, which causes the fold line 115 to break apart at the line of perforations or scores 130. This results in the contents or ingredients in the top compartment 104 falling by gravity flow into the bottom compartment 108 and mixing with the contents or ingredients in the bottom compartment 108. Alternatively, after the fold line 115 is broken apart at the line of perforations or scores 130, the pouch 102 may be shaken or agitated by other means to allow for the contents in the top compartment 104 to mix with the contents in the bottom compartment 108.

The two-compartment pouch 102 shown in FIG. 4 (*b*) may alternatively have a tack seal region 132 located above the fold line 115 in the inner gusset 112 that tacks or seals the front wall 122 to both sides of the "V" of the inner gusset and also the rear wall of the pouch 102. The tack seal region 132 may facilitate the tearing of the line of perforations or scores 130 in the inner gusset 112 fold line 115. The tack seal region 132 may be formed by any means known in the art, including, but not limited to heat sealing, ultrasonic sealing and adhesive sealing. The tack seal region 132 may be of any shape or configuration, including, but not limited to, a dog-bone, a line, a square, a rectangle, a circle, or a diamond.

This disclosed embodiment described in FIGS. 1, 2, 3 and 4 need not be limited to packaging food items. The multi-component pouch may package any two solid, liquid or combinations thereof items that need to be separated prior to use and comingled or mixed at time of use. For example, the compartments may contain non-food items, such as cleaning products or other types of household, garden or industrial products. The exemplary embodiment described in FIGS. 1, 2, 3 and 4 also need not be limited to pouches including two compartments. For example, the multi-compartment pouch may include three, four, five or six different compartments with inner gussets separating each pair of adjacent compartments. One of the benefits of the multi-compartment pouch is that allows for the mixing of items just prior to use without having to open the pouch to do so. This eliminates the possible contamination of the items during the mixing or comingling process. The multi-compartment pouch as described above also allows for simultaneous filling of the two or more compartments when a side edge is left open for the filling process and also simultaneously sealing of the side edge to form a side seal after the simultaneous filling step is complete. Another advantage of the multi-compartment pouch disclosed herein is that it may be formed on traditional pouch making machinery and filled on traditional pouch filling machines with just tooling changes for each process.

Exemplary Embodiment 2 Including Outer Folds

Figure 5:
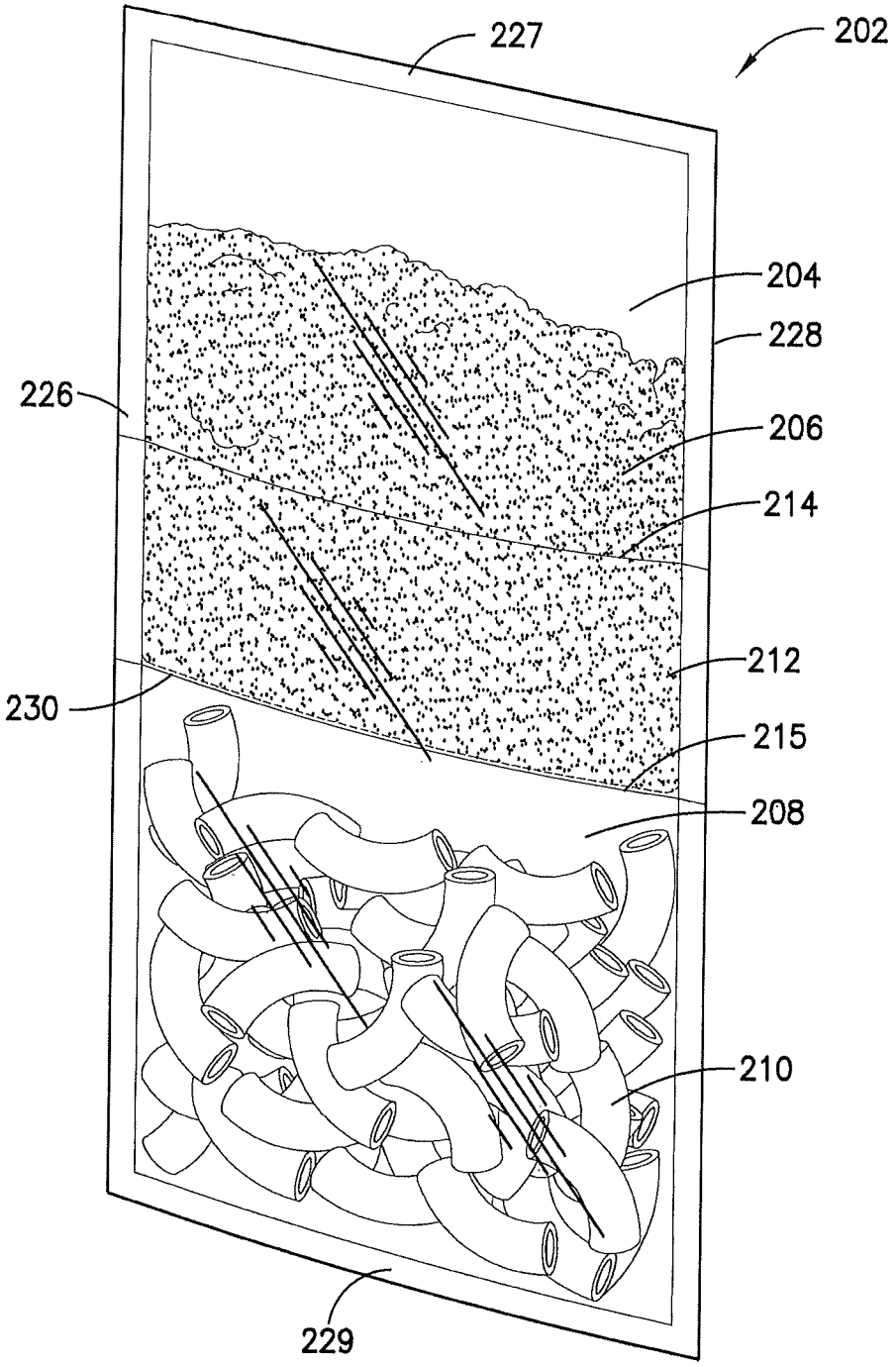
FIG. 5 depicts a second exemplary multi-compartment pouch including two compartments and two outer folds for pulling apart a folded openable inner gusset.

Another embodiment of a multi-compartment pouch 202 with outer folds 214 for initiating the opening of the inner gusset 212 along a fold line 215 including a line of perforations or scores 230 is shown in FIG. 5. The multi-compartment pouch 202 has two compartments and includes a top compartment 204 including one ingredient 206 (dried cheese) and a bottom compartment 208 including a second ingredient 210 (pasta). The multi-compartment pouch of FIG. 5 (also referred to as a two-compartment pouch) 202 is sealed along the two side edges 226, 228 as well as the top and bottom edges 227, 229 to keep both ingredients enclosed therein. The side edges 226, 228 and the top and bottom edges 227, 229 may be sealed by any means known in the art, including, but not limited to, heat sealing, ultrasonic sealing and adhesive sealing. In addition, there is a seal (not shown) between the top compartment 204 and the bottom compartment 208 to fix the position of the top compartment 204 relative to the bottom compartment 208. The ingredient 206 in the top compartment 204 rests upon the fold line 215 in the inner gusset 212. A line of perforations or scores 230 in the fold line 215 or alternatively a peelable seal, a zipper assembly, a hook and loop fastener assembly or combinations thereof in or adjacent to the fold line 215 forms an openable region in the inner gusset 212. As discussed above for embodiment 1, the relative sizes of the top and bottom compartments 204, 208 are dictated by the volumes of the respective ingredients or contents for packaging. As discussed above, a combination of perforations, score lines, a peelable seal, a zipper assembly, a hook and loop fastener assembly may be used in providing an openable area in the inner gusset 212 separating the top compartment 204 from the bottom compartment 208.

Figure 6:
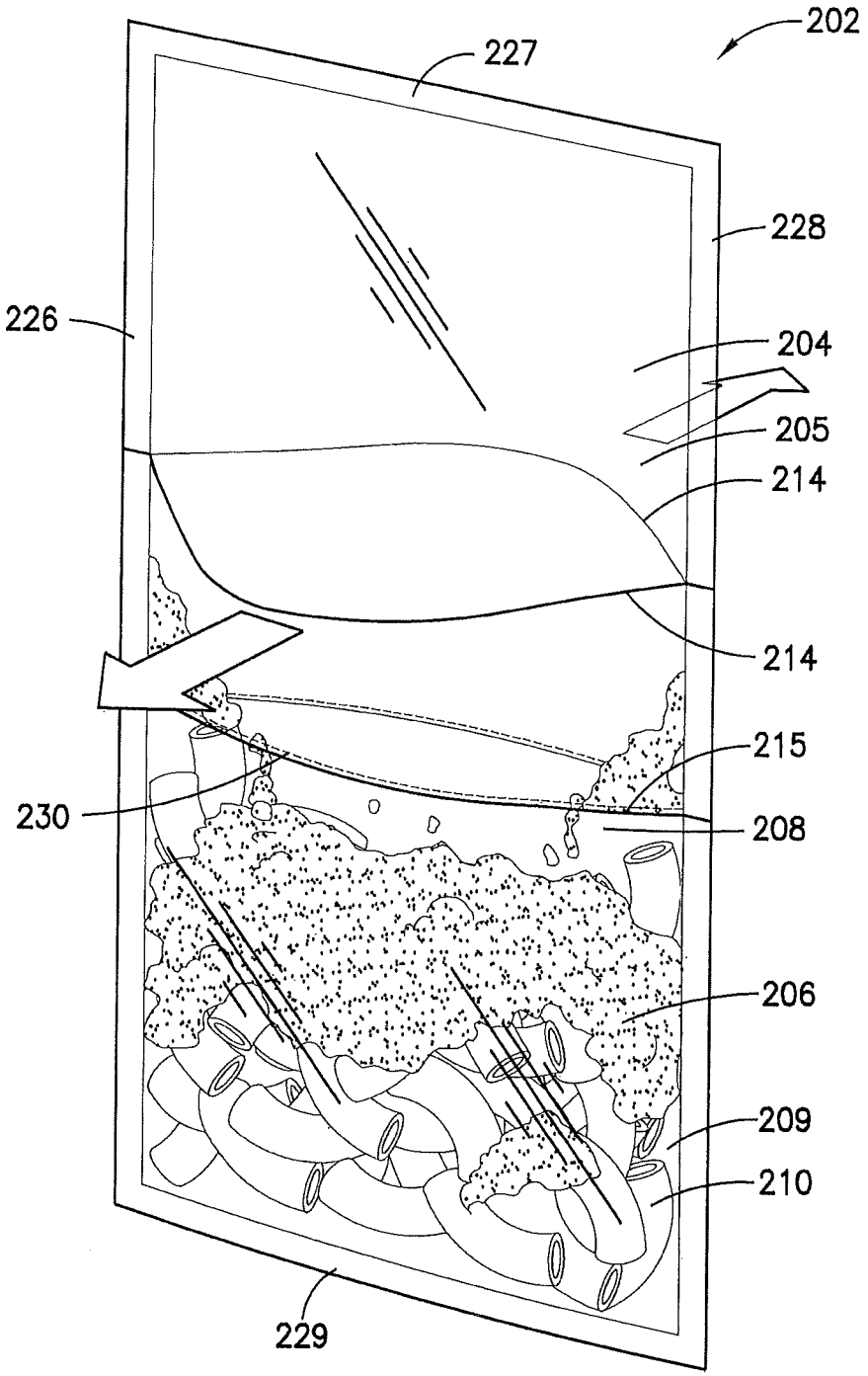
FIG. 6 depicts the second exemplary multi-compartment pouch of FIG. 5 with the folded openable inner gusset open to allow for the pouring of dried cheese seasoning from the top compartment to the bottom compartment of the pouch.

As shown in FIG. 6, when the user of the pouch 202 desires to mix the contents or ingredients 206 of the top compartment 204 with the contents or ingredients 210 of the bottom compartment 208, he or she would grasp the outer folds 214 on either side of the front wall 222 and rear wall 224 of the pouch 202 and pull the outer folds 214 in opposite directions and away from the center of the pouch 202. The pulling force on the outer folds 214 causes the inner gusset 212 to unfold, and results in the line of perforations or scores 230 in the fold line 215 to open up or fracture, which creates an opening between the top compartment 204 and bottom compartment 208. As a result, the contents or ingredients 206 in the top compartment 204 fall by gravity feed and/or by shaking into the bottom compartment 208 and mix with the contents or ingredients 210 therein. Alternatively, if the openable region is a peelable seal, the pulling force on the outer folds causes the peelable seal to unpeel to create an opening in the inner gusset. Alternatively, if the openable region in the inner gusset is a zipper assembly, the pulling force on the outer folds causes the zipper to pull apart to create an opening in the inner gusset. Alternatively, if the openable region in the inner gusset is a hook and loop fastener assembly, the pulling force on the outer folds causes the hooks to separate from the fasteners to create an opening in the inner gusset. The perforations, score line, peelable seal, zipper assembly, hook and loop fastener assembly or combinations thereof need not be located in the fold line 215, but may also be located on either side of the fold line or on both sides of the fold line as described in embodiment 1 above. The multi-compartment pouch 202 remains sealed to the outside during this process of opening the top compartment 204 to the bottom compartment 208. The user of the pouch 202 may then tear the top empty portion 205 of the pouch 202 from the bottom portion 209 of the pouch 202, which includes both ingredients 206, 210 mixed together. This opens the pouch 202 to the atmosphere to further facilitate use or subsequent processing (for example, eating, heating or cooking of the mixed ingredients). To facilitate the tearing of the top empty portion 205 of the pouch 202 from the bottom portion 209 of the pouch 202, a notch or cut-out (not shown) may be put in one or both sides of the side edges 226, 228 of the pouch 202.

Figure 7:
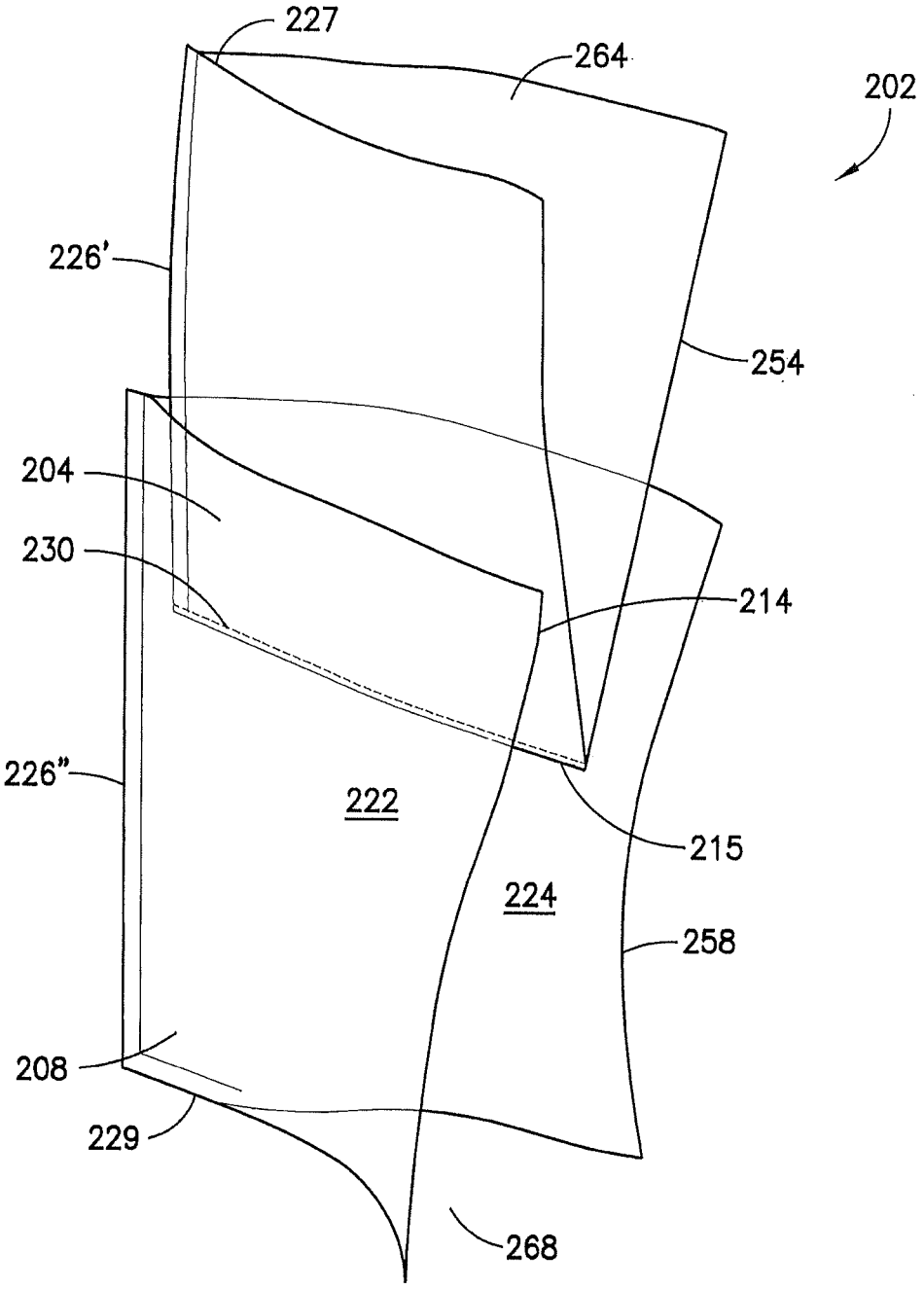
FIG. 7 depicts an exemplary perspective view of a method of forming the multi-compartment pouch including two compartments and two outer folds of FIGS. 5 and 6.

Referring to FIG. 7, an exemplary perspective view of a method of forming the multi-compartment pouch 202 including two compartments and two outer folds of FIGS. 5 and 6 is shown. The multi-compartment pouch 202 with two compartments is formed by providing a top front and back panel region 254 and a bottom front and back panel region 258. The bottom front and back panel region 258 forms the bottom compartment 208 of the pouch 202. The top front and back panel region 254 forms the top compartment 204 including the inner gusset 212 of the pouch 202. The bottom front and back panel region 258 may be smaller in width than the bottom front and back panel region 258 such that it may inserted into the top opening of the bottom front and back panel region 258. The top front and back panel region 254 also includes a fold line 215 with a line of perforations or scores 230 in it. Alternatively, the line of perforations or scores 230 may be replaced with a peelable seal, a zipper assembly, hook and loop fastener assembly or combinations thereof. The relative size of the top compartment 204 to the bottom compartment 208 is determined by how far the top front and back panel region 254 is inserted into the bottom front and back panel region 258. The further in distance it is inserted, the greater will be the relative size of the top compartment 204 to the bottom compartment 208. The area of the bottom front and back panel region 258 that extends above the fold line 215 in the top front and back panel region 254 forms the outer folds 214 in the front wall 222 and back wall 224 of the multi-compartment pouch 202. The top front and back panel region 254 is sealed to the bottom front and back panel region 258 along the two side edges 226, 228 of the pouch 202. Once both side edges 226', 228' for the top front and back panel region 254 are sealed to both side edges 226", 228" for the bottom front and back panel region 258, an empty multi-compartment pouch 202 with a top compartment 204 and a bottom compartment 208 is formed. This is a "pouch within a pouch" type of arrangement with a folded inner gusset wall 212 separating the two compartments, wherein the gusset 212 includes a fold line 215 with a line of perforations or scores 230 to form a weakened frangible area separating the two compartments 204, 208. The contents or ingredients 206 for the top compartment 204 are inserted through the top end opening 264 and the contents or ingredients 210 for the bottom compartment 208 are inserted through the bottom end opening 268 of the pouch 202. In this form, the top compartment 204 and the bottom compartment of the pouch 202 must be filled sequentially as the pouch would need to be flipped 180 degrees after the top compartment 204 is filled and sealed and prior to the bottom compartment 208 being filled and sealed. The top edge 227 and bottom edge 229 of the pouch 202 are then sealed via heat, ultrasonic, or adhesive or other means known in the art for sealing plastic films together.

When the user is ready to mix the ingredients or contents 206 in the top compartment 204 with the ingredients or contents 210 in the bottom compartment 208, he or she would grasp the outer folds 214 on either side of the pouch 202 and pull outward to expand the inner gusset 212 and cause the line of perforations or scores 230 (or alternatively other type of openable means (peelable seal, zipper assembly or hook and loop fastener assembly)) in the fold line 215 to open up or fracture as described above. This creates an opening between the top compartment 204 and the bottom compartment 208 causing the contents or ingredients 206 in the top compartment 204 to fall by gravity and/or by shaking and mix with the contents or ingredients 210 in the bottom compartment 208.

Figure 8:
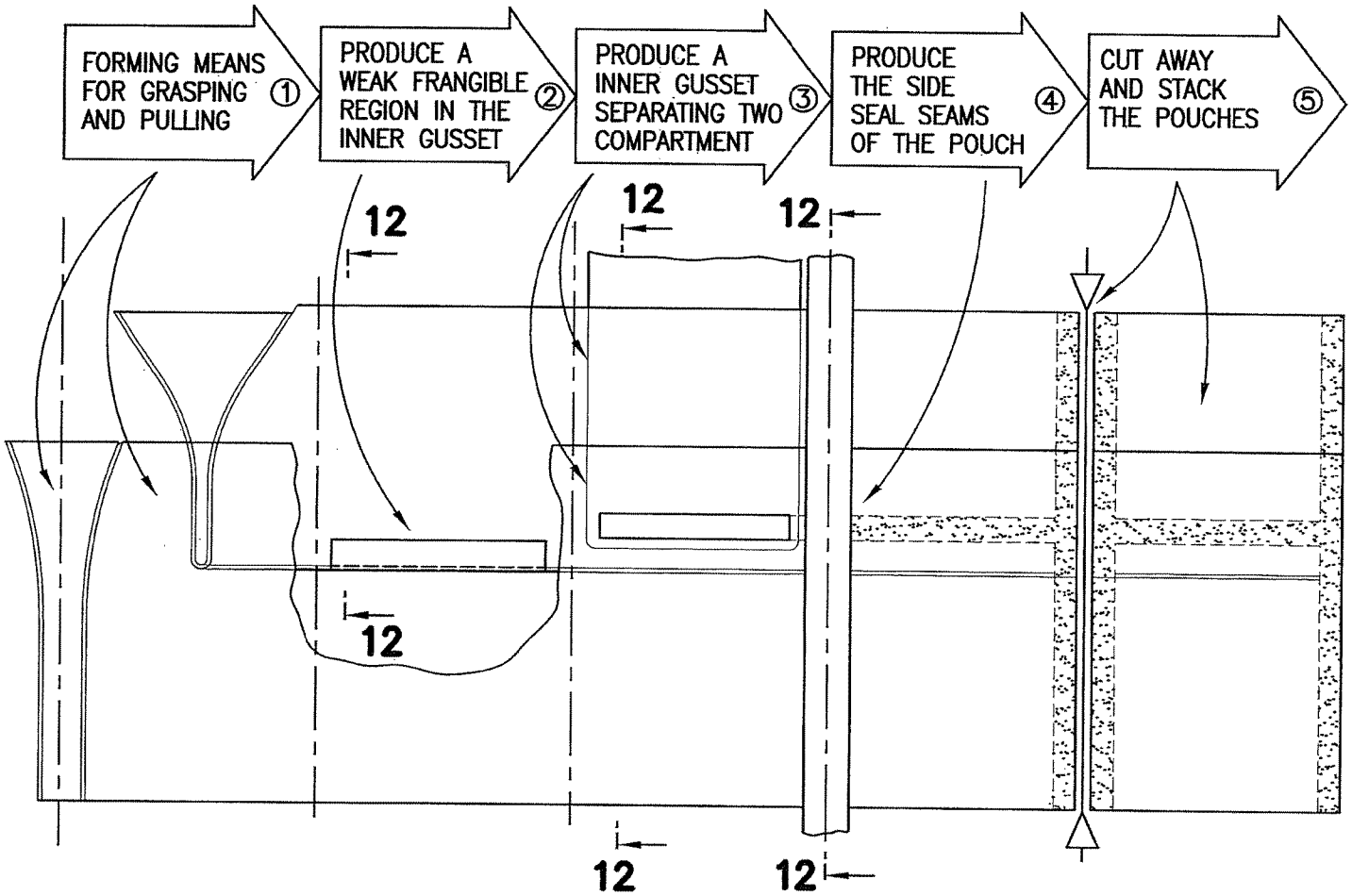
FIG. 8 depicts an exemplary production sequence for producing the two-compartment top and bottom fillable pouch of FIGS. 5 to 7.

Referring to FIG. 8, depicted is an exemplary production sequence for producing the two-compartment top and bottom fillable pouch of FIGS. 5 to 7. The production sequence is a five-step process that includes: 1) a pouch forming step including producing a means for grasping and pulling on the outer panels of the pouch via outer folds, 2) a step for forming a weakened frangible region (via perforations or score lines) or alternatively a non-weakened openable region (via peelable seal, zipper, or hook and loop fastener) in the inner gusset, 3) a step for sealing the inner gusset relative to the top and bottom compartments of the two-compartment pouch, 4) a step for forming the side seals or seams in the pouch, and 5) a step for cutting away the top and bottom fillable pouches from one another and then stacking them.

In an alternative form of embodiment 2, the multi-compartment pouch may be sealed on one side edge (226' and 226" or 228' and 228") and the other side edge left open. In this form, the top edge 227 and bottom edge 229 of the pouch 202 are also sealed. This form provides for the ability to simultaneously side fill and seal both the top compartment 204 and bottom compartment 208 of the pouch 202. In this advantageous form of the embodiment, both top 204 and bottom 208 compartments may be side filled simultaneously by rotating the pouch 90 degrees such that the unsealed side edge is facing up for filling and subsequent sealing. In this form, the sealing of the two compartments 204, 208 may also occur simultaneously after the filling operation. This form of the embodiment 2 provides for economic benefits for the person or entity who/that will be filling and sealing the pouch due to fewer process operations and steps.

Figure 9:
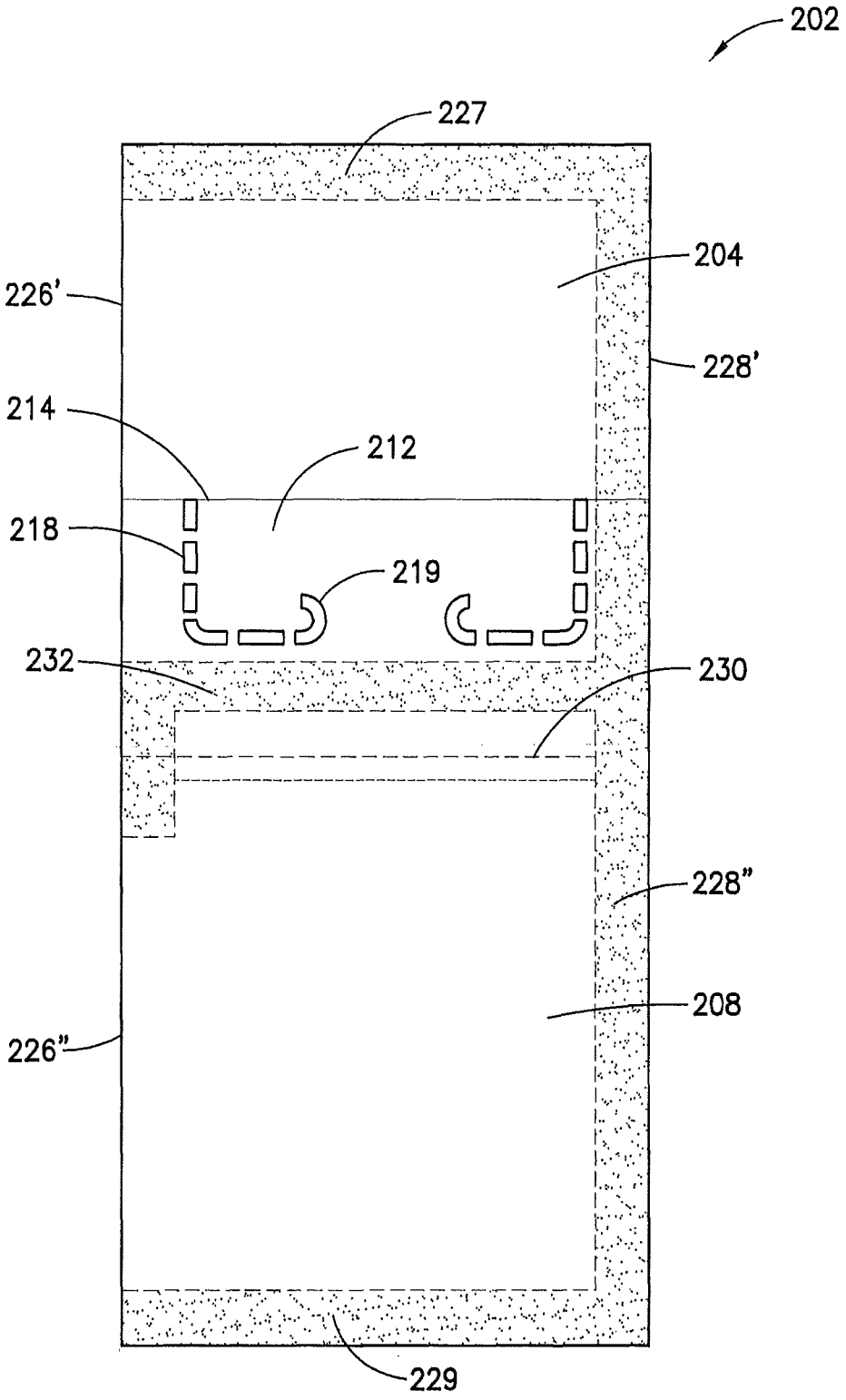
FIG. 9 depicts the second exemplary side fillable multi-compartment pouch including two compartments and two outer folds for pulling apart a folded openable inner gusset of FIGS. 5 and 6 with perforations in the outer folds.

Referring to FIG. 9, depicted is another form of the second embodiment of the exemplary multi-compartment pouch 202 of FIGS. 5 and 6, which includes a top compartment 204 and a bottom compartment 208 and two outer folds 214 for pulling apart a folded openable inner gusset 212 with perforations or scores 218 located in the outer folds 214. The perforations or scores 218 in the outer folds 214 are depicted in FIG. 9 as L-shaped with a hook 219 at the end of the "L." This creates a pull tab for further ease of pulling the two outer folds 214 apart to open the folded openable inner gusset 212 separating the top compartment 204 from the bottom compartment 208. The two "Ls" are not interconnected such that there is a film region in between each fold 214 that is not perforated or scored in order to provide that the pull tab is still attached to the pouch 202 after it has been pulled by the user. The hook 219 at the end of each "L"

provides further strength to the pull tab toward the end of the perforated area in each fold 214. The perforations or scores 218 in the outer folds 214 need not be "L-shaped", but may take on a variety of other shapes, including, but not limited to "I-shaped", "J-shaped", etc.

Referring again to FIG. 9, the multi-compartment pouch 202 includes a line of perforations 230 in the folded openable inner gusset 212 to create a weakened frangible region that breaks/ruptures/opens when the two outer folds 214 are pulled by the user in outward and opposite directions. Alternatively, the line of perforations 230 in the folded openable inner gusset 212 may be replaced with another openable means discussed above, including, but not limited to, a peelable seal, a zipper assembly, a hook and loop fastener assembly and combinations thereof. The line of perforations 230 may be advantageously positioned at the fold line in the folded openable inner gusset 212 or alternatively on one side of the fold line. In another form, the openable means in the inner gusset 212 may include any of the configurations depicted and described in FIG. 11 below.

Referring again to FIG. 9, depicted is a multi-compartment pouch 202 that may be side filled, and thus, both top 204 and bottom 208 compartments may be simultaneously filled and subsequently simultaneously sealed. As shown in FIG. 9, the left side edge 226' of the top compartment 204 and the left side edge 226" of the bottom compartment 208 are not sealed when the pouch 202 does not contain any product. In contrast, the right side edge 228' of the top compartment 204 and the right side edge 228" of the bottom compartment 208 are sealed when the pouch 202 does not contain any product. In addition, the top edge 227 of the top compartment 204 and the bottom edge 229 of the bottom compartment 208 are also sealed. Also shown in FIG. 9, there is also a seal 232 between the top compartment 204 and the bottom compartment 208 to fix the position of the top compartment 204 relative to the bottom compartment 208. This form of embodiment 2 of the multi-component pouch 202 allows for both the top compartment 204 and the bottom compartment 208 to be filled simultaneously, and subsequently sealed simultaneously. Seal methods known in the art may be utilized for each of the seals, including, but not limited to, heat sealing, ultrasonic sealing and adhesive sealing.

Figure 10:
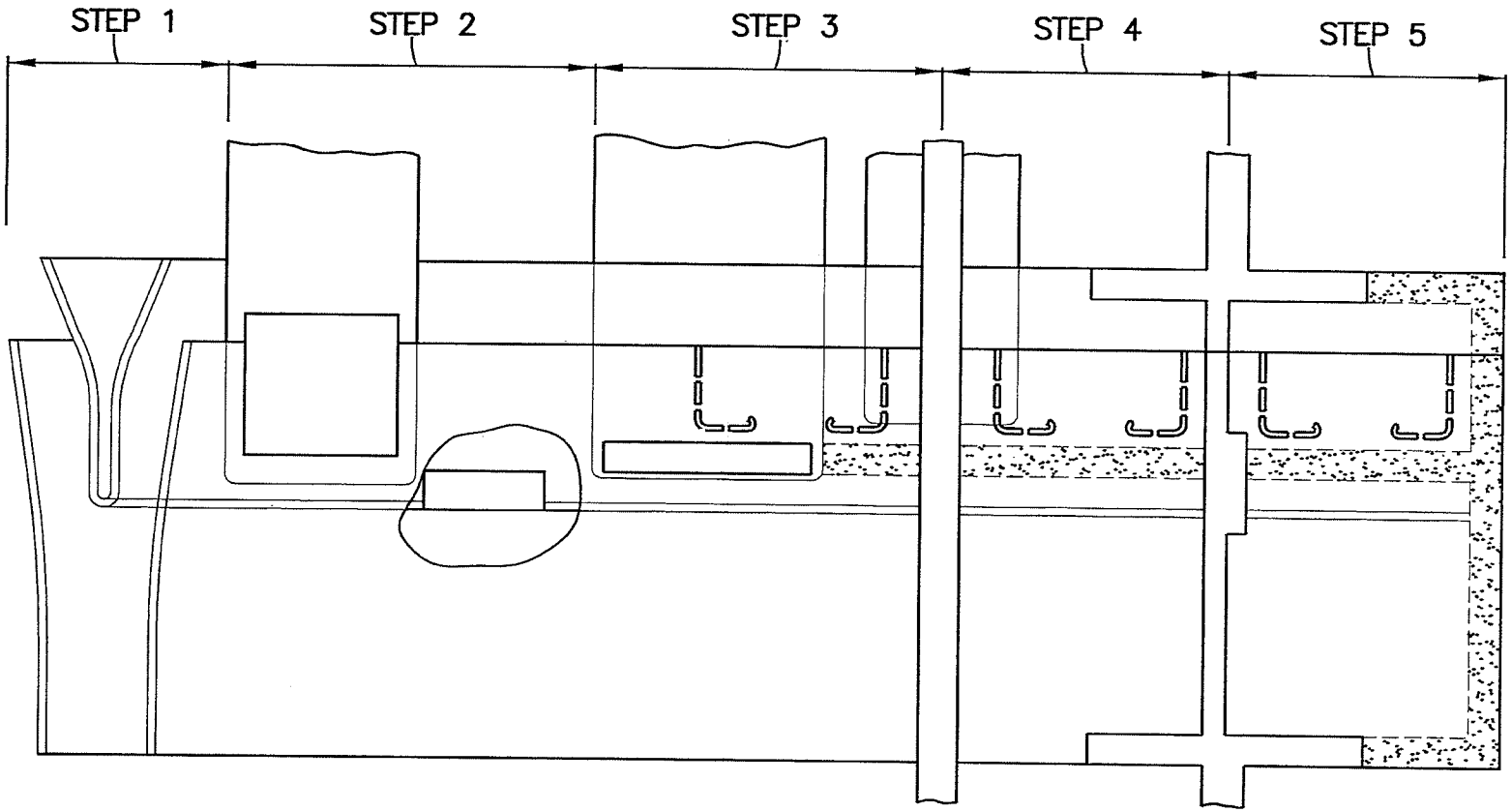
FIG. 10 depicts an exemplary production sequence for producing the two-compartment side fillable pouch of FIG. 9.

An exemplary production sequence for producing the two-compartment side fillable pouch of FIG. 9 is depicted in FIG. 10. The production sequence is a five-step process that includes: 1) a pouch forming step including producing a means for grasping and pulling on the outer panels of the pouch via outer folds, 2) compartment pouch and forming "L-shaped" perforation lines in the outer folds and a step for forming a weakened frangible region (via perforations or score lines) or alternatively a non-weakened openable region (via a peelable seal, zipper, or hook and loop fastener) in the inner gusset, 3) a step for sealing the inner gusset relative to the top and bottom compartments of the two-compartment pouch and forming "L-shaped" perforation lines in the outer folds, 4) a step for forming one set of side seals or seams and top and bottom seals or seams in the pouch, and 5) a step for cutting away the side fillable pouches from one another and stacking them.

Other Features

Figure 11:
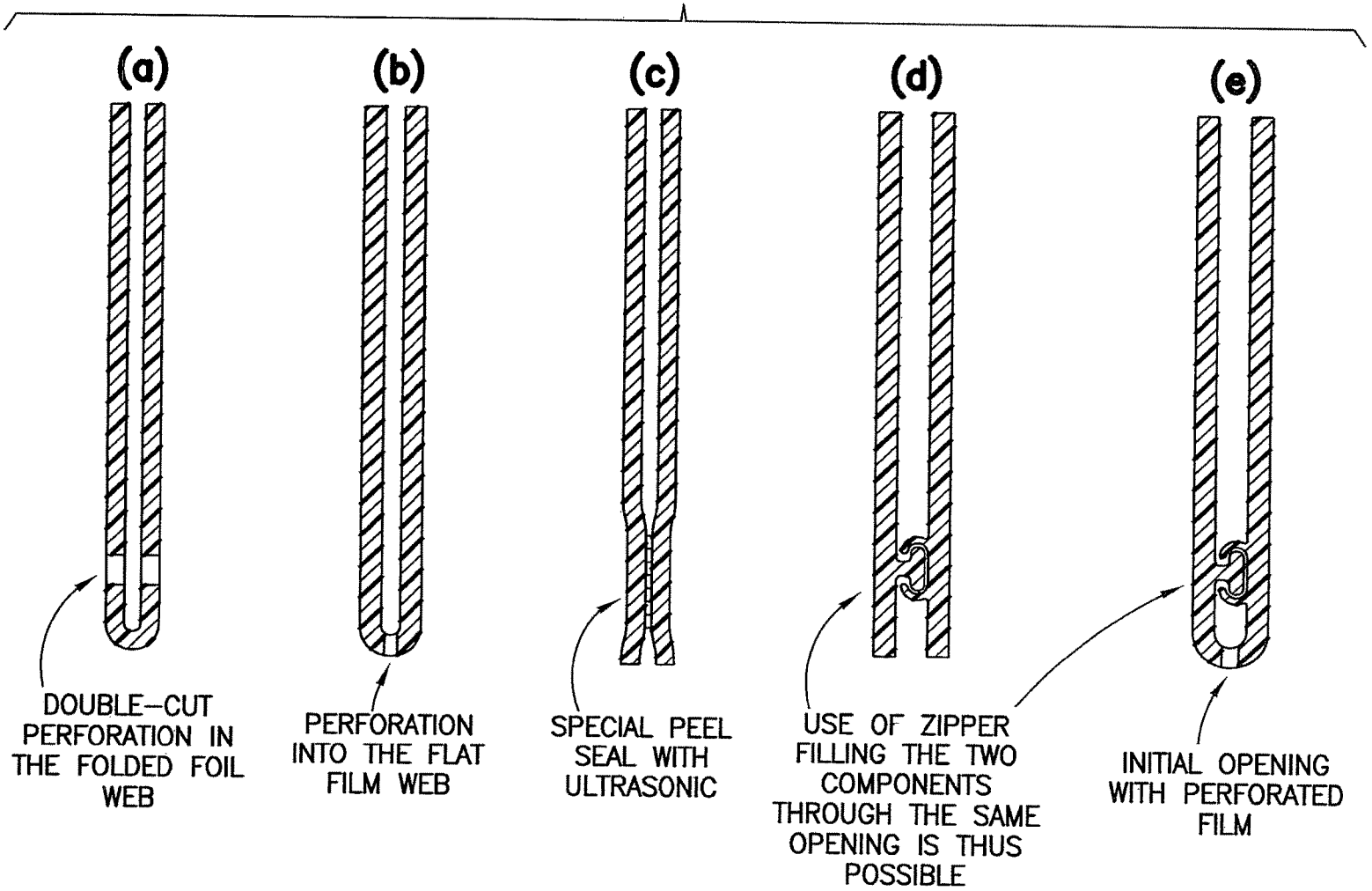
FIG. 11 depicts five different alternatives for the configuration of the folded openable inner gusset using different opening means and combinations of opening means.

The folded openable inner gusset described above in embodiments 1 and 2 of the present disclosure may take on a variety of configurations depending upon the openable means used (line of perforations, score line, peelable seal, zipper assembly, hook and loop fastener assembly or combinations thereof). FIG. 11 depicts five different alternatives for the folded openable inner gusset. In FIG. 11 (*a*), two lines of perforations (one on each side of the fold line) are used to provide a weakened frangible area that will open upon exerting an outward force causing the inner gusset to unfold. An advantage of this form is that the two lines of perforations provide for easier opening of the inner gusset. A disadvantage of this form is that a piece of the inner gusset may possibly fall into the bottom compartment of the pouch upon fracturing or breaking, and thus contaminating the product therein. In FIG. 11 (*b*), a single line of perforations is located at the fold line and is used to provide a weakened frangible area that will open upon exerting an outward force causing the inner gusset to unfold. In FIG. 11 (*c*), a peelable seal is formed at the fold line of the inner gusset, which may be unpeeled and opened upon exerting an outward force causing the inner gusset to unfold. In FIG. 11 (*d*), a zipper assembly seal is formed at the fold line of the inner gusset, which may be unzipped and opened upon exerting an outward force causing the inner gusset to unfold. In FIG. 11 (*e*), a line of perforations is formed at the fold line of the inner gusset with a zipper assembly positioned above the inner gusset. In this form, the line of perforations provides a weakened frangible area that will initially open upon exerting an outward force causing the inner gusset to unfold. Upon further application of force, the zipper assembly will also unzip and open to fully open the inner gusset to allow for ingredients in the top compartment to pass into the bottom compartment of the pouch. The zipper assembly may also be reclosed to provide for the inner gusset to be resealed, and hence reclose the opening from the top compartment to the bottom compartment. This may be an advantageous feature when only a portion of the contents of the top compartment are to be mixed with the contents of the bottom compartment. The recloseable zipper assembly allows for the remaining contents of the top compartment to be stored and later mixed with the bottom compartment contents via reopening of the zipper assembly.

Figure 12:
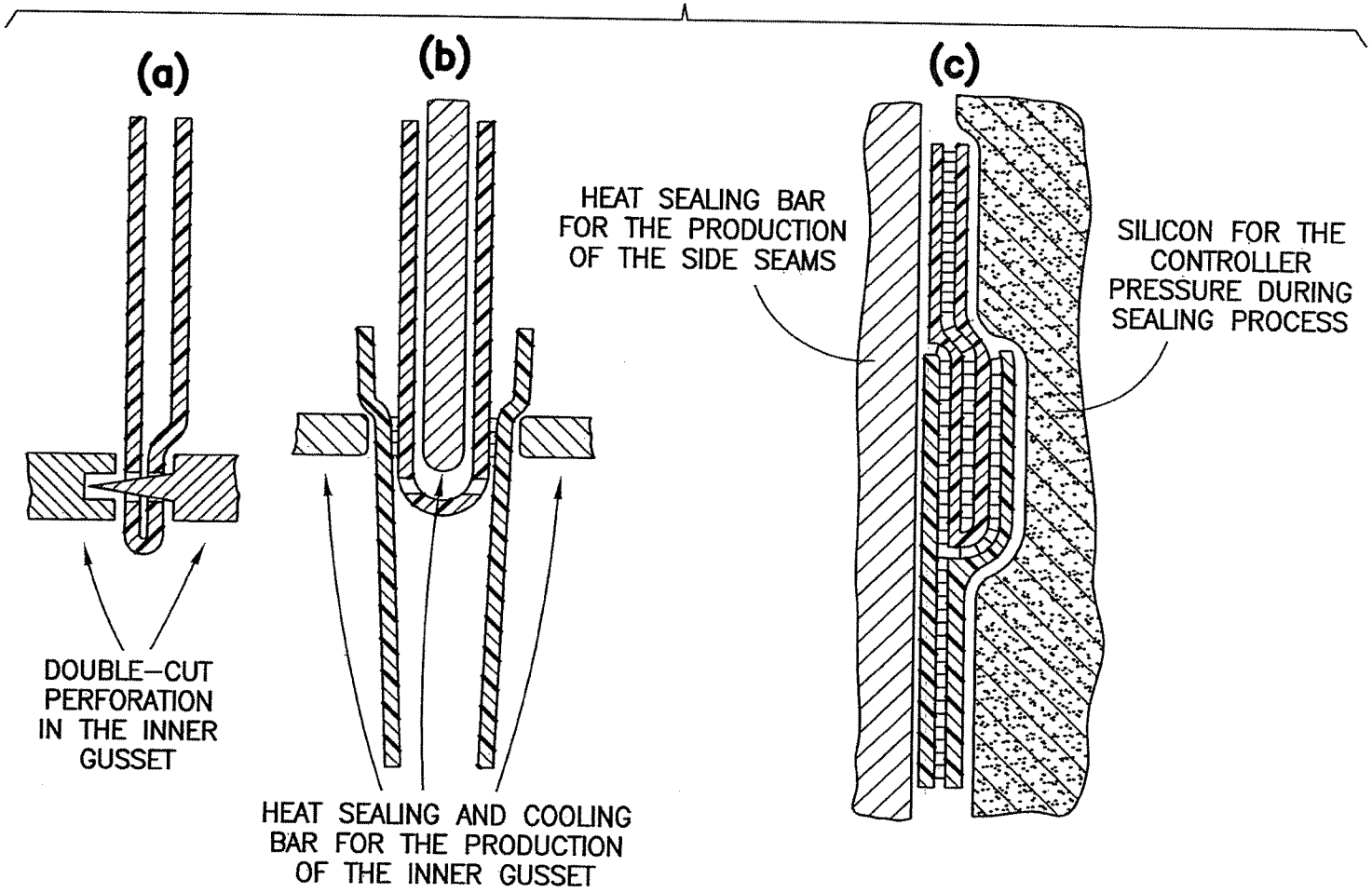
FIG. 12 depicts side sectional views of three process steps in producing the openable folded inner gusset and side seals of the multi-compartment pouch.

Referring to FIGS. 12 (*a*), (b) and (c), three non-limiting exemplary production steps for producing the openable folded inner gusset and side seals of the multi-compartment pouches described above are shown. In FIG. 12 (*a*), a mechanical means is used to produce two lines of perforations on either side of the fold line of the openable inner gusset. This double-cut perforation may alternatively be formed via a laser scoring method. After the openable means are formed in the folded inner gusset, FIG. 12 (*b*) depicts how the inner gusset of the top compartment is secured to the bottom compartment via a heat seal bar and optional cooling bar. After the folded openable inner gusset is sealed within the pouch, FIG. 12 (*c*) depicts how the side seams or seals of the pouch are formed via heat sealing bars. The heat sealing step may alternatively be done via ultrasonic sealing or adhesive sealing.

According to the present disclosure, an advantageous two-compartment pouch includes a top compartment and a bottom compartment, an inner gusset separating the top compartment from the bottom compartment, wherein the inner gusset includes a fold line and an openable region, and a means for grasping and pulling apart the front and rear panels of the pouch to cause the openable region to open to allow for the combining of contents of the top compartment with contents of the bottom compartment without opening the pouch.

A further aspect of the present disclosure relates to an advantageous multi-compartment pouch comprising: two or more compartments, one or more inner gussets separating each of the two or more compartments, wherein each inner gusset includes a fold line and an openable region, and a means for grasping and pulling apart the front and rear panels of the pouch to cause the openable region at each inner gusset to open to allow for the combining of contents of the contents of the two or more compartments without opening the pouch.

These and other features and attributes of the disclosed multi-component pouches of the present disclosure and their advantageous applications and/or uses will be apparent from the detailed description which follows, particularly when read in conjunction with the figures appended hereto.

In accordance with one or more aspects of the disclosed embodiment a two-compartment pouch comprises a top compartment and a bottom compartment, an inner gusset separating the top compartment from the bottom compartment, wherein the inner gusset includes an openable region and a fold line, and a means for grasping and pulling apart the front and rear panels of the pouch to cause the openable region to open to allow for the combining of contents of the top compartment with contents of the bottom compartment without opening the pouch.

In accordance with one or more aspects of the disclosed embodiment wherein the means for grasping and pulling apart the front and rear panels of the pouch are chosen from tabs, fins, handles and outer folds.

In accordance with one or more aspects of the disclosed embodiment wherein the openable region is a weakened frangible region including one or more lines of perforations or scores positioned at or adjacent to the fold line.

In accordance with one or more aspects of the disclosed embodiment wherein the openable region is a non-weakened region chosen from a peelable seal, a zipper assembly, a hook and loop fastener assembly positioned at or adjacent to the fold line.

In accordance with one or more aspects of the disclosed embodiment wherein the top compartment is unsealed at the top of the pouch and the bottom compartment is unsealed at the bottom of the compartment to permit the sequential filling of the top compartment and the bottom compartment.

In accordance with one or more aspects of the disclosed embodiment wherein the top compartment and bottom compartments are unsealed along a common side edge of the pouch to permit the simultaneous filling of the top compartment and bottom compartment.

In accordance with one or more aspects of the disclosed embodiment and further including contents sealed in the top compartment and the bottom compartment.

In accordance with one or more aspects of the disclosed embodiment wherein the contents of the top compartment and the contents of the bottom compartment are different.

In accordance with one or more aspects of the disclosed embodiment wherein the means for grasping and pulling apart the front and rear panels are two outer folds.

In accordance with one or more aspects of the disclosed embodiment wherein the two outer folds further include two lines of perforations in each outer fold to form a pull tab in the each outer fold.

In accordance with one or more aspects of the disclosed embodiment wherein the lines of perforations in each outer fold are "L-shaped" with a hook at the end of each "L".

In accordance with one or more aspects of the disclosed embodiment wherein the openable region includes a combination of two or more chosen from a line of perforations or scores, a peelable seal, a zipper assembly, and a hook and loop fastener assembly, wherein the combination is positioned at or adjacent to the fold line.

In accordance with one or more aspects of the disclosed embodiment further including a tack seal region located in the top compartment of the pouch above the fold line, wherein the tack seal region tack seals the inner gusset to the front and rear panels of the pouch.

In accordance with one or more aspects of the disclosed embodiment and further including a means for removing/separating the top compartment from the bottom compartment.

In accordance with one or more aspects of the disclosed embodiment and further including a means for reclosing the bottom compartment after it is removed/separated from the top compartment.

In accordance with one or more aspects of the disclosed embodiment a multi-compartment pouch comprises two or more compartments, one or more inner gussets separating each of the two or more compartments, wherein each inner gusset includes an openable region and a fold line, and a means for grasping and pulling apart the front and rear panels of the pouch to cause the openable region at each inner gusset to open to allow for the combining of the contents of the two or more compartments without opening the pouch.

In accordance with one or more aspects of the disclosed embodiment wherein the means for grasping and pulling apart the front and rear panels of the pouch are chosen from tabs, fins, handles and outer folds.

In accordance with one or more aspects of the disclosed embodiment wherein at least one of the openable regions is a weakened frangible region including one or more lines of perforations or scores positioned at or adjacent to the fold line.

In accordance with one or more aspects of the disclosed embodiment wherein at least one of the openable regions is a non-weakened region chosen from a peelable seal, a zipper assembly, a hook and loop fastener assembly positioned at or adjacent to the fold line.

In accordance with one or more aspects of the disclosed embodiment wherein the compartment at the top of the pouch is unsealed at the top and the compartment at the bottom of the pouch is unsealed at the bottom to permit the sequential filling of the top compartment and the bottom compartment.

In accordance with one or more aspects of the disclosed embodiment wherein each of the two or more compartments are unsealed along a common side edge of the pouch to permit the simultaneous filling of each of the two or more compartments.

In accordance with one or more aspects of the disclosed embodiment further including contents sealed in each of the two or more compartments.

In accordance with one or more aspects of the disclosed embodiment wherein the contents in each of the two or more compartments are different.

In accordance with one or more aspects of the disclosed embodiment wherein the means for grasping and pulling apart the front and rear panels are two outer folds.

In accordance with one or more aspects of the disclosed embodiment wherein the outer folds further include two lines of perforations in each outer fold to form a pull tab in the each outer fold.

In accordance with one or more aspects of the disclosed embodiment wherein the lines of perforations in each outer fold are "L-shaped" with a hook at the end of each "L".

In accordance with one or more aspects of the disclosed embodiment wherein at least one openable region includes a combination of two or more chosen from a line of perforations or scores, a peelable seal, a zipper assembly, and a hook and loop fastener assembly, wherein the combination is positioned at or adjacent to the fold line of the inner gusset.

In accordance with one or more aspects of the disclosed embodiment and further including at least one tack seal region located in the one or more compartments of the pouch above the fold line, wherein the tack seal region tack seals the inner gusset to the front and rear panels of the pouch.

In accordance with one or more aspects of the disclosed embodiment and further including a means for removing/separating one compartment from one or more other compartments.

In accordance with one or more aspects of the disclosed embodiment and further including a means for reclosing the one or more other compartments after they are removed/separated from the one compartment.

It should be understood that the foregoing description is only illustrative of the aspects of the disclosed embodiment. Various alternatives and modifications can be devised by those skilled in the art without departing from the aspects of the disclosed embodiment. Accordingly, the aspects of the disclosed embodiment are intended to embrace all such alternatives, modifications and variances that fall within the scope of the appended claims. Further, the mere fact that different features are recited in mutually different dependent or independent claims does not indicate that a combination of these features cannot be advantageously used, such a combination remaining within the scope of the aspects of the invention.

What is claimed is:

1. A two-compartment pouch comprising:

a top compartment and a bottom compartment, an inner gusset separating the top compartment from the bottom compartment, wherein the inner gusset includes an openable region and a fold line, and a means for grasping and pulling apart the front and rear panels of the pouch to cause the openable region to open to allow for the combining of contents of the top compartment with contents of the bottom compartment without opening the pouch, wherein the means for grasping and pulling apart the front and rear panels are two outer folds, and a tack seal region located in the top compartment of the pouch above the fold line, wherein the tack seal region tack seals both sides of the inner gusset to the front and rear panels of the pouch at an intermediary position between the top of the "V" and the bottom of the "V" of the inner gusset, wherein the tack seal region facilitates the tearing of the one or more lines of perforations or scores in the weakened frangible region of the inner gusset, wherein the openable region is a weakened frangible region including one or more lines of perforations or scores positioned at or adjacent to the fold line and wherein the openable region traverses the entire width of the inner gusset of the top compartment.

2. The pouch of claim 1, wherein the top compartment is unsealed at the top of the pouch and the bottom compartment is unsealed at the bottom of the compartment to permit the sequential filling of the top compartment and the bottom compartment.

3. The pouch of claim 1, wherein the top compartment and bottom compartments are unsealed along a common side edge of the pouch to permit the simultaneous filling of the top compartment and bottom compartment.

4. The pouch of claim 1, further including contents sealed in the top compartment and the bottom compartment.

5. The pouch of claim 4, wherein the contents of the top compartment and the contents of the bottom compartment are different.

6. The pouch of claim 1, wherein the two outer folds further include two lines of perforations in each outer fold to form a pull tab in the each outer fold.

7. The pouch of claim 6, wherein the lines of perforations in each outer fold are "L-shaped" with a hook at the end of each "L".

8. The pouch of claim 1, wherein the openable region includes a combination of two or more chosen from a line of perforations or scores, a peelable seal, a zipper assembly, and a hook and loop fastener assembly, wherein the combination is positioned at or adjacent to the fold line.

9. The pouch of claim 1, wherein the tack seal region is in the shape of a dog-bone, a line, a square, a rectangle, a circle or a diamond.

10. The pouch of claim 1, further including a means for removing/separating the top compartment from the bottom compartment.

11. The pouch of claim 10, further including a means for reclosing the bottom compartment after it is removed/separated from the top compartment.

12. A multi-compartment pouch comprising:

two or more compartments, one or more inner gussets separating each of the two or more compartments, wherein each inner gusset includes an openable region and a fold line, and a means for grasping and pulling apart the front and rear panels of the pouch to cause the openable region at each inner gusset to open to allow for the combining of the contents of the two or more compartments without opening the pouch, wherein the means for grasping and pulling apart the front and rear panels are two outer folds, and at least one tack seal region located in at least one compartment of the pouch above the fold line, wherein the tack seal region tack seals both sides of the inner gusset to the front and rear panels of the pouch at an intermediary position between the top of the "V" and the bottom of the "V" of the inner gusset, wherein the tack seal region facilitates the tearing of the one or more lines of perforations or scores in the weakened frangible region of the inner gusset, wherein the openable region is a weakened frangible region including one or more lines of perforations or scores positioned at or adjacent to the fold line and wherein each openable region traverses the entire width of the two or more compartments.

13. The pouch of claim 12, wherein the compartment at the top of the pouch is unsealed at the top and the compartment at the bottom of the pouch is unsealed at the bottom to permit the sequential filling of the top compartment and the bottom compartment.

14. The pouch of claim 12, wherein each of the two or more compartments are unsealed along a common side edge of the pouch to permit the simultaneous filling of each of the two or more compartments.

15. The pouch of claim 12, further including contents sealed in each of the two or more compartments.

16. The pouch of claim 15, wherein the contents in each of the two or more compartments are different.

17. The pouch of claim 12, wherein the outer folds further include two lines of perforations in each outer fold to form a pull tab in the each outer fold.

18. The pouch of claim 17, wherein the lines of perforations in each outer fold are "L-shaped" with a hook at the end of each "L".

19. The pouch of claim 12, wherein at least one openable region includes a combination of two or more chosen from a line of perforations or scores, a peelable seal, a zipper assembly, and a hook and loop fastener assembly, wherein the combination is positioned at or adjacent to the fold line of the inner gusset.

20. The pouch of claim 12, wherein the at least one tack seal region is in the shape of a dog-bone, a line, a square, a rectangle, a circle or a diamond.

21. The pouch of claim 12, further including a means for removing/separating one compartment from one or more other compartments.

22. The pouch of claim 21, further including a means for reclosing the one or more other compartments after they are removed/separated from the one compartment.

* * * * *